US010254014B2

(12) United States Patent
Miyoshi et al.

(10) Patent No.: US 10,254,014 B2
(45) Date of Patent: Apr. 9, 2019

(54) CENTRIFUGAL CHILLER

(71) Applicant: MITSUBISHI HEAVY INDUSTRIES THERMAL SYSTEMS, LTD., Tokyo (JP)

(72) Inventors: Naoya Miyoshi, Tokyo (JP); Kenji Ueda, Tokyo (JP); Yasushi Hasegawa, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 0 days.

(21) Appl. No.: 15/329,914

(22) PCT Filed: Aug. 10, 2015

(86) PCT No.: PCT/JP2015/072609
§ 371 (c)(1),
(2) Date: Jan. 27, 2017

(87) PCT Pub. No.: WO2016/035514
PCT Pub. Date: Mar. 10, 2016

(65) Prior Publication Data

US 2017/0254568 A1 Sep. 7, 2017

(30) Foreign Application Priority Data

Sep. 5, 2014 (JP) ..... 2014-181334

(51) Int. Cl.
*F25B 1/10* (2006.01)
*F25B 39/00* (2006.01)
(Continued)

(52) U.S. Cl.
CPC ..... *F25B 1/10* (2013.01); *F25B 1/053* (2013.01); *F25B 39/00* (2013.01); *F25B 39/04* (2013.01);
(Continued)

(58) Field of Classification Search
CPC .... F25B 1/10; F25B 2400/13; F25B 2400/23; F25B 43/006
(Continued)

(56) References Cited

U.S. PATENT DOCUMENTS 2,277,647 A * 3/1942 Jones ..... F25B 1/053 62/197
3,022,638 A * 2/1962 Caswell ..... F25B 1/053 62/115
(Continued)

FOREIGN PATENT DOCUMENTS

JP 53-157462 U 12/1978
JP 53157462 U * 12/1978
JP 59-52352 B2 12/1984

OTHER PUBLICATIONS

Hitachi, JP 53157462 U, Dec. 1978, English Translatioin, European Patent Office.*
Hitachi, Dec. 1978, European Patent Office, English Translation.*

*Primary Examiner* — Orlando E Aviles Bosques
*Assistant Examiner* — Steve Tanenbaum
(74) *Attorney, Agent, or Firm* — Birch, Stewart, Kolasch & Birch, LLP

(57) ABSTRACT

A centrifugal chiller in which a closed-cycle refrigeration cycle is formed by connecting a compressor, a condenser, an economizer and decompression means forming a multi-stage compression cycle, and an evaporator, with the refrigeration cycle being charged with a low-pressure refrigerant. The condenser and the economizer are integrated with each other by having a portion of their vessel walls form a shared wall, with the base surface of the economizer being positioned below the base surface of the condenser and above the base surface of the evaporator.

4 Claims, 3 Drawing Sheets

(51) Int. Cl.

| | |
|---|---|
| ***F25B 41/06*** | (2006.01) |
| ***F25B 43/00*** | (2006.01) |
| ***F25B 39/04*** | (2006.01) |
| ***F25B 1/053*** | (2006.01) |
| ***F25B 25/00*** | (2006.01) |

(52) U.S. Cl.
CPC ..... *F25B 41/062* (2013.01); *F25B 43/006* (2013.01); *F25B 25/005* (2013.01); *F25B 2339/047* (2013.01); *F25B 2341/0661* (2013.01); *F25B 2341/0662* (2013.01); *F25B 2400/13* (2013.01); *F25B 2400/23* (2013.01); *F25B 2500/18* (2013.01)

(58) Field of Classification Search
USPC ..... 62/510
See application file for complete search history.

(56) References Cited

U.S. PATENT DOCUMENTS

| | | | | |
|---|---|---|---|---|
| 3,240,265 | A * | 3/1966 | Weller | F25B 39/02 165/108 |
| 4,144,717 | A * | 3/1979 | Anderson | F25B 1/053 62/117 |
| 2003/0209030 | A1 * | 11/2003 | Nishida | F25B 41/00 62/500 |

* cited by examiner

CENTRIFUGAL CHILLER

TECHNICAL FIELD

The present invention relates to a centrifugal chiller that is charged with a low-pressure refrigerant, such as an HCFO refrigerant, during a refrigeration cycle.

BACKGROUND ART

Conventionally, in a centrifugal chiller, an HFC refrigerant, such as R134a refrigerant, is used as the refrigerant. HFC refrigerants belong to high-pressure refrigerants, and are known to have a high global warming potential (GWP). Given this, recently, in order to reduce environmental impact, attention is being given to the R1233zd(E) refrigerant, which is an HCFO (hydrochlorofluoroolefin) refrigerant, and its adoption in centrifugal chillers is being considered. The R1233zd(E) refrigerant is a low-pressure refrigerant and is known for its low density.

Further, in a centrifugal chiller that uses a high-pressure refrigerant, vessels utilized for constituent devices, such as a condenser, an evaporator, an economizer, and a subcooler, pressure vessels are required, and their strength is secured by using circular drums. As a result, each of the constituent devices is configured using an independent vessel, and a configuration is adopted in which each of the vessels is arranged independently. Meanwhile, when a low-pressure refrigerant is used, since the strength of the vessels in each of the constituent devices can be decreased, the circular drum need not necessarily be used, and a square drum or the like can be selected, for example. In Patent Document 1, a single-drum type centrifugal chiller is disclosed in which vessel walls are shared.

Patent Document 1 is an application made at a time when specified fluorocarbon refrigerants (HCFC refrigerants), which are low-pressure refrigerants, were used, and discloses a centrifugal chiller that is made more compact by integrating a plurality of devices by sharing the vessel walls of the various constituent devices. HCFC refrigerants include the chlorine group, their ozone depletion potential (ODP) is high, and they are considered to be a weapon contributing to the depletion of the ozone layer. From this, there has been a history of HCFC refrigerants being replaced by HFC refrigerants, which are high-pressure refrigerants. As a result of this, there has been a trend to use circular drums that can secure a high degree of strength as the vessels of the various constituent devices.

CITATION LIST

Patent Literature

Patent Document 1: Japanese Unexamined Patent Application Publication No. S59-52352A

SUMMARY OF INVENTION

Technical Problem

However, in the centrifugal chiller disclosed in Patent Document 1, a condenser, an economizer, and an evaporator, which have extremely different temperature levels, are each integrated via shared walls. Furthermore, a refrigerant flow path from the condenser to the economizer, and an orifice provided in that flow path, as well as a refrigerant flow path from the economizer to the evaporator, and an orifice provided in that flow path, each have a configuration in which an outlet or an inlet of the refrigerant flow path are provided inside the economizer.

Therefore, although the centrifugal chiller can be made more compact, heat loss occurs as a result of heat exchange between the condenser and the evaporator, and also, a fixed orifice functioning as a decompression mechanism is provided inside the economizer. From this, a situation arises in which controllability is poor, and controllability is particularly difficult to secure in a low load area. Further, since the refrigerant is the low-pressure refrigerant, a pressure difference cannot be sufficiently secured in a low compression area (the low load area), and for example, if a fluid surface difference of the refrigerant is not secured between the economizer and the evaporator, problems such as a deterioration in the flow of the refrigerant resulting in a deterioration in refrigeration capability can occur.

In light of the foregoing, an object of the present invention is to provide a centrifugal chiller capable of suppressing the occurrence of heat loss and also capable of sufficiently securing the controllability of a refrigerant flow and a flow rate thereof under any operating conditions, when various constituent devices of the centrifugal chiller charged with a low-pressure refrigerant are integrated by sharing vessel walls.

Solution to Problem

In order to solve the above-described problem, the centrifugal chiller of the present invention adopts the following means.

Specifically, a centrifugal chiller according to a first aspect is a centrifugal chiller in which a closed-cycle refrigeration cycle is formed by connecting a compressor, a condenser, an economizer forming a multi-stage compression cycle, and an evaporator, with the refrigeration cycle being charged with a low-pressure refrigerant during the cycle. The condenser and the economizer are integrated with each other by having a portion of their vessel walls form a shared wall, and a base surface of the economizer is positioned below a base surface of the condenser, and above a base surface of the evaporator.

According to the first aspect of the present invention, the condenser and the economizer configuring a multi-stage compression refrigeration cycle of the centrifugal chiller that is charged with the low-pressure refrigerant are integrated with each other by having a portion of their vessel walls form a shared wall, and the base surface of the economizer is positioned below the base surface of the condenser and above the base surface of the evaporator. Thus, by the condenser and the economizer being integrated with each other as a result of having a portion of their vessel walls form the shared wall, the centrifugal chiller can be made more compact. In addition, the liquid refrigerant condensed in the condenser can be subcooled by the refrigerant separated and evaporated on the economizer side, via the shared wall. Furthermore, heat exchange between the condenser and the evaporator, which have a large difference in temperature between them, can be avoided. Further, respective differences of elevation between the condenser and the economizer and between the economizer and the evaporator can be secured, and the refrigerant flow caused by gravity can also be anticipated. Therefore, along with being able to reduce heat loss and improve efficiency, a subcooling degree is secured in a low load area and stable expansion valve control is realized, thus allowing stable and efficient operation to be performed. Further, even when a high-low pressure difference has become small due to operating conditions, the refrigerant flow can be reliably secured and stable operation can be performed.

Furthermore, according to the centrifugal chiller of a second aspect of the present invention, with respect to the above-described centrifugal chiller, each of the decompression means provided to the front and rear of the economizer is an expansion valve. Refrigerant piping or branching piping, which is provided between the condenser and the economizer and which is provided with a first expansion valve or an economizer expansion valve, and refrigerant piping, which is provided between the economizer and the evaporator and which is provided with a second expansion valve, are respectively provided on the outside of various devices.

According to the second aspect of the present invention, each of the decompression means provided to the front and rear of the economizer is the expansion valve. The refrigerant piping or branching piping, which is provided between the condenser and the economizer and which is provided with the first expansion valve or the economizer expansion valve, and the refrigerant piping, which is provided between the economizer and the evaporator and which is provided with the second expansion valve, are respectively provided on the outside of the various devices. As a result, higher-stage decompression means, lower-stage decompression means, and economizer decompression means that are the decompression means when the multi-stage compression refrigeration cycle is configured to be provided with the economizer (which is a gas-liquid separator or an intercooler), are respectively the first expansion valve, the economizer expansion valve, and the second expansion valve. These various expansion valves are provided in the refrigerant piping and the branching piping provided on the outside of the various devices. In this way, the flow rate of the refrigerant can be appropriately controlled as necessary in accordance with operating conditions, using each of the expansion valves. Thus, controllability in a low load area is stabilized in particular, and stable and efficient operation can be realized.

Furthermore, in the centrifugal chiller according to a third aspect of the present invention, with respect to either of the above-described centrifugal chillers, a height dimension H of a vessel of the economizer is greater than a width dimension W thereof.

According to the third aspect of the present invention, the height dimension H of the vessel of the economizer is greater than the width dimension W thereof. As a result, a degree of freedom is imparted to a gas-side shape that forms an upper portion of the economizer, a capacity thereof can be sufficiently secured, thus obtaining a configuration that makes carry-over of the economizer unlikely. Thus, the centrifugal chiller that forms the multi-stage compression refrigeration cycle can operate in a stable manner, and the reliability thereof can be improved.

Furthermore, in the centrifugal chiller according to a fourth aspect of the present invention, with respect to any of the above-described centrifugal chillers, the economizer is integrated with the condenser by having a portion of their vessel walls form a shared wall so as to cover a bottom portion of the condenser.

Furthermore, according to the fourth aspect of the present invention, the economizer is integrated with the condenser by having a portion of their vessel walls form the shared wall so as to cover the bottom portion of the condenser. As a result, the bottom portion of the condenser, in which condensed and liquefied refrigerant collects, is efficiently cooled via the shared wall with the economizer, and the liquid refrigerant can be subcooled. Thus, even in a low load area in which a subcooler or the like cannot easily function, the liquid refrigerant can be appropriately subcooled, and the expansion valve control can be stabilized while avoiding a gas bypass.

Advantageous Effects of Invention

According to the present invention, by the condenser and the economizer being integrated with each other as a result of having a portion of their vessel walls form the shared wall, the centrifugal chiller can be made more compact. In addition, the liquid refrigerant condensed in the condenser can be subcooled by the refrigerant separated and evaporated on the economizer side, via the shared wall. Furthermore, the heat exchange between the condenser and the evaporator, which have a large difference in temperature between them, can be avoided. Further, the respective differences of elevation between the condenser and the economizer and between the economizer and the evaporator can be secured, and the refrigerant flow caused by gravity can also be anticipated. Therefore, along with being able to reduce heat loss and improve efficiency, the subcooling degree is secured in the low load area and the stable expansion valve control is realized, thus allowing the stable and efficient operation to be performed. Further, even when a high-low pressure difference has become small due to operating conditions, the refrigerant flow can be reliably secured and stable operation can be performed.

DESCRIPTION OF EMBODIMENTS

Embodiments of the present invention will be described below with reference to the drawings.

First Embodiment

A first embodiment of the present invention will be described below, with reference to FIGS. 1 and 2.

Figure 1:
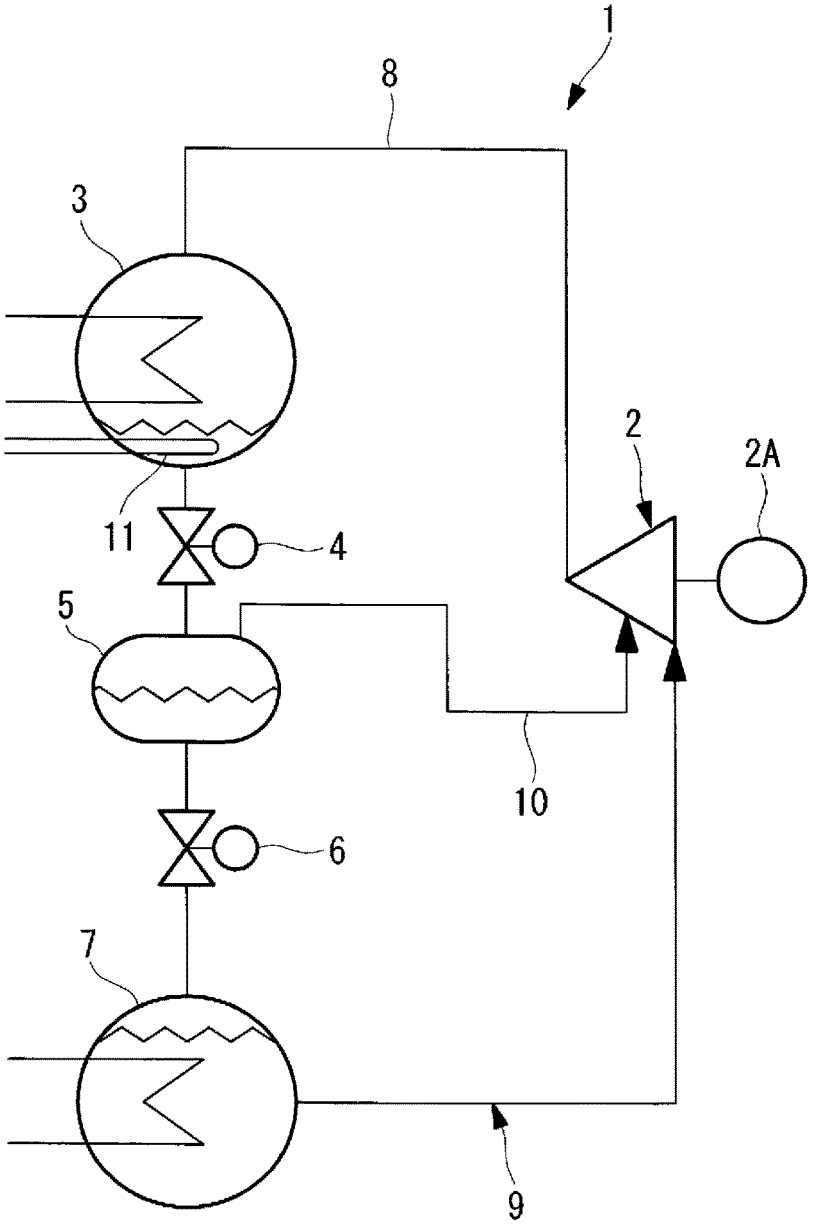
FIG. 1 is a refrigeration cycle diagram of a centrifugal chiller according to a first embodiment of the present invention.

In FIG. 1, a refrigeration cycle diagram of a centrifugal chiller according to the first embodiment of the present invention is illustrated. In FIG. 2, a configuration diagram of a layout of various devices configuring the centrifugal chiller is illustrated.

A centrifugal chiller 1 is driven by a motor 2A, and is provided with a closed-cycle refrigeration cycle 9 configured by sequentially connecting, using refrigerant piping 8, a multi-stage turbo compressor (sometimes simply referred to as a compressor) 2 that compresses a refrigerant, a shell-and-tube type condenser 3 that condenses and liquefies high-temperature, high-pressure refrigerant gas compressed by the compressor 2, a first expansion valve 4, which is higher-stage decompression means that reduces the pressure of the compressed liquid refrigerant to an intermediate pressure, an economizer (a gas-liquid separator) 5 that functions as an economizer, a second expansion valve 6, which is lower-stage decompression means that reduces the pressure of the liquid refrigerant to a low pressure, and a shell-and-tube type evaporator 7 that evaporates the refrigerant that has passed through the second expansion valve 6.

The refrigeration cycle 9 of the present embodiment is provided with a known economizer circuit 10 configured to inject, via an intermediate port, the gas refrigerant separated and evaporated at the economizer 5 into the intermediate-pressure refrigerant gas compressed at the lower-stage side of the multi-stage turbo compressor 2. Here, the economizer circuit 10 is the gas-liquid separation type two-stage compression and two-stage expansion cycle economizer circuit 10, in which the economizer 5 is configured by the gas-liquid separator. In contrast to this, the economizer circuit 10 may be an intercooler type two-stage compression and one-stage expansion cycle economizer circuit in which the economizer 5 is an intercooler that causes the flow of one part of the refrigerant condensed by the condenser 3 to be divided, reduces the pressure of that refrigerant using an economizer expansion valve, and causes heat exchange with a liquid coolant. Either of these examples is known configurations.

Note that, in the present embodiment, a configuration is adopted in which the subcooler (supercooler) 11 is provided in a lower portion inside the condenser 3, and the liquid refrigerant condensed by the condenser 3 can be subcooled, but, in the present invention, the subcooler (supercooler) 11 need not necessarily be provided and may be omitted.

Further, in order to reduce the environmental impact, it is assumed that the above-described refrigeration cycle 9 is charged to a required amount with the R1233zd(E) refrigerant, which is a HCFO (hydrochlorofluoroolefin) refrigerant and which has both a low global warming potential (GWP) and low ozone depletion potential (ODP). The R1233zd(E) refrigerant is a low-pressure refrigerant with a low density, and is known to have approximately ⅕of the density of a high-pressure refrigerant, such as the R134a refrigerant, an HFC refrigerant used in existing centrifugal chillers.

Figure 2:
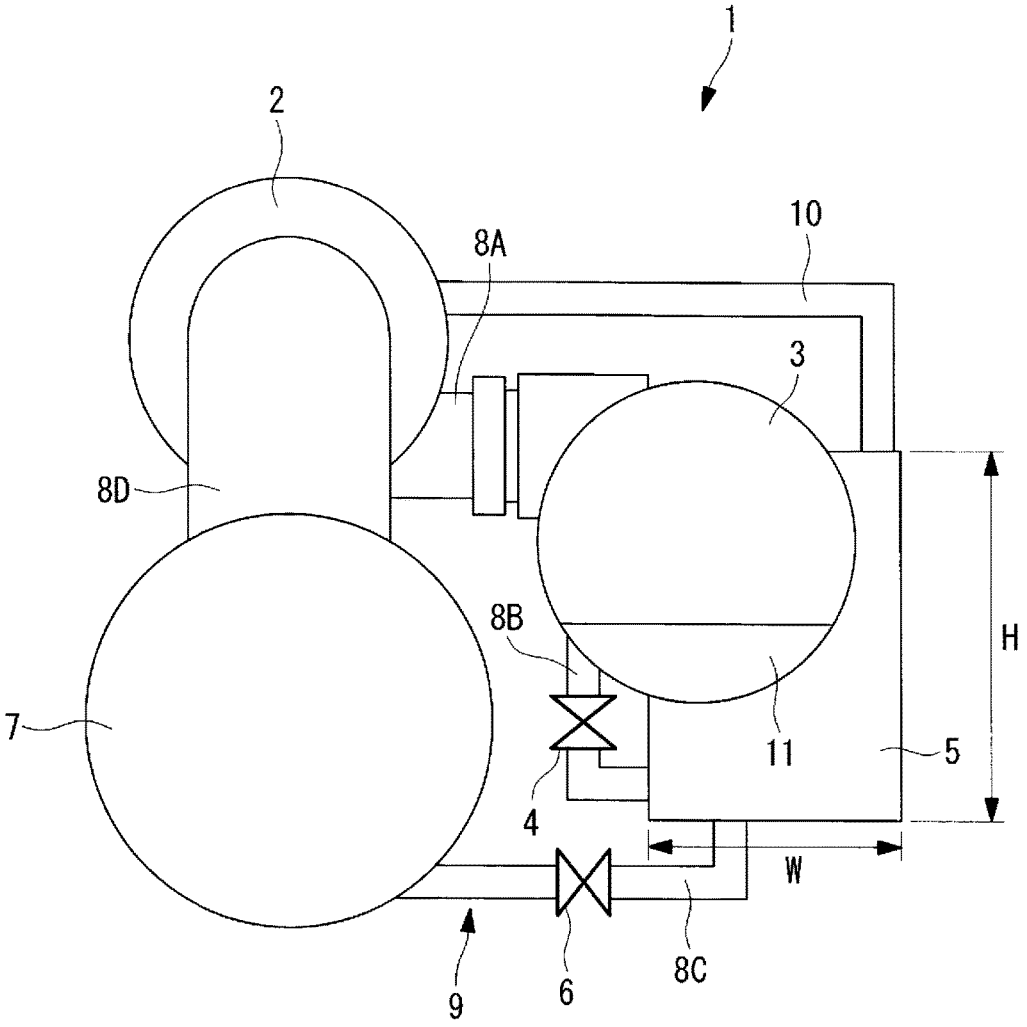
FIG. 2 is a configuration diagram illustrating a layout of various devices configuring the above-mentioned centrifugal chiller.

Meanwhile, FIG. 2 is a configuration diagram illustrating a layout of various devices configuring the refrigeration cycle 9 of the above-described centrifugal chiller 1.

In the present embodiment, a configuration is adopted in which the compressor 2 and the evaporator 7 are each independently arranged, while the economizer 5 configuring the economizer circuit 10 is integrated with the condenser 3 and the subcooler 11 (which are provided independently from the compressor 2 and the evaporator 7), by having a portion of their vessel walls form a shared wall. Note that here, the condenser 3 and the evaporator 7 use circular drum shaped shells, but they are not limited to the circular drums, and may be square drums or the like.

Then, of the various above-described devices, the compressor 2 and the condenser 3 are connected via discharge piping (refrigerant piping) 8A, the condenser 3/subcooler 11 and the economizer 5 are connected via refrigerant piping 8B provided with the first expansion valve 4, the economizer 5 and the evaporator 7 are connected via refrigerant piping 8C provided with the second expansion valve 6, the evaporator 7 and the compressor 2 are connected via intake piping (refrigerant piping) 8D, and the economizer 5 and an intermediate port of the compressor 2 are connected via the economizer circuit 10, thus configuring the closed-cycle refrigeration cycle 9. Each of the refrigerant piping 8A, 8B, 8C, and 8D, and the economizer circuit 10 are disposed on the outside of each of the devices that are arranged independently.

Further, the condenser 3/subcooler 11 and the economizer 5 are integrated with each other such that a portion of a bottom portion of the condenser 3 and the subcooler 11 that have the circular drum shape is covered by the rectangular shaped economizer (gas-liquid separator) 5 being integrally provided by having a partially shared wall with an outer peripheral wall of the drum wall, from the bottom portion toward an upper portion of a side portion. Of the economizer 5, a height dimension H is greater than a width dimension W, and the economizer circuit 10 is connected to the intermediate port of the compressor 2 from a top surface of the economizer 5.

In addition, as illustrated in FIG. 2, the base surface of the above-described economizer (gas-liquid separator) 5 is positioned below the bottom portion (the base surface) of the condenser 3 and the subcooler 11, and is positioned above the base surface of the evaporator 7. In this way, the refrigerant liquefied in the condenser 3 can flow sufficiently to the economizer 5 from the bottom portion of the condenser 3 and to the subcooler 11 as a result of gravity, regardless of a pressure difference, and can flow from the bottom portion of the economizer 5 to the evaporator 7.

Incidentally, an operating pressure difference (a difference between a condensing pressure and an evaporating pressure) of the centrifugal chiller 1 is as follows when the high-pressure refrigerant (the R134a refrigerant) is used and when and the low-pressure refrigerant (the R1233zd(E) refrigerant) is used: approximately 95 to 10 kPa in the case of the R1233zd(E) refrigerant in contrast to approximately 560 to 65 kPa in the case of the R134a refrigerant. Specifically, the saturation pressure at 37° C. (the rated operation heat source side condensation temperature), the saturation pressure at 12° C. (the heat source side minimum condensation temperature at partial load) and the saturation pressure at 7° C. (the rated operation output side evaporation temperature) for each of the refrigerants are as follows. In the case of the R134a refrigerant, they are 937.24 kPa, 443.01 kPa, and 374.63 kPa. The maximum differential pressure (rated operation) thereof is 562.61 kPa, and the minimum differential pressure (operation at partial load) is 68.38 kPa. Meanwhile, in the case of the R1233zd(E) refrigerant, the respective values are 139.73 kPa, 54.951 kPa, and 44.520 kPa. The maximum differential pressure (rated operation) is 95.21 kPa, the minimum differential pressure (operation at partial load) is 10.431 kPa, and the high-low pressure difference significantly deteriorates.

According to the configuration described above, the present embodiment achieves the following operational effects.

In the above-described centrifugal chiller 1, when the compressor 2 is driven by the motor 2A, the low-pressure gas refrigerant is taken up from the evaporator 7, and is subject to multi-stage compression to form the high-temperature, high-pressure refrigerant gas. The high-temperature, high-pressure refrigerant gas discharged from the compressor 2 is fed into the condenser 3, and is condensed and liquefied there as a result of heat exchange with a cooling fluid. This liquid refrigerant passes through the first expansion valve 4, the economizer 5, and the second expansion valve 6 and is subcooled and reduced to a low pressure, before being guided to the evaporator 7. The refrigerant guided to the evaporator 7 exchanges heat with a medium to be cooled, and cools the medium to be cooled, thus itself becoming vaporized. The vaporized refrigerant is taken into the compressor 2 and compressed once again, and the operation is repeated.

Additionally, the intermediate-pressure refrigerant that is separated and evaporated in the economizer (gas-liquid separator) 5 and that has subcooled the liquid refrigerant passes through the economizer circuit 10 and is injected into the intermediate-pressure gas refrigerant compressed at a lower-stage compression portion, from the intermediate port of the multi-stage turbo compressor 2. In this way, an effect is achieved of providing the economizer that improves the cooling capability.

Meanwhile, the refrigeration cycle 9 of the centrifugal chiller 1 is filled with the R1233zd(E) refrigerant, which is a low-pressure refrigerant that has a low global warming potential (GWP) and low ozone depletion potential (ODP). This refrigerant is a low-pressure refrigerant and has a low density, (approximately ⅕ of the density of the R134a refrigerant), and it is thus considered to be difficult to secure the capability thereof. However, the turbo compressor is generally considered to be suitable for the compression of a large flow rate of the refrigerant, and the above-described weak point can be offset by increasing the refrigerant circulation amount through high-speed rotation.

Further, when the low-pressure refrigerant is used, the various devices configuring the centrifugal chiller 1 need not necessarily have the circular drum shape, and, in the present embodiment, the economizer 5 has a rectangular shape and is integrated by having a portion of the outer peripheral wall of the condenser 3 and the subcooler 11 as a shared wall, thus enabling the centrifugal chiller 1 to be more compact. Specifically, when the high-pressure refrigerant is used, each of the devices needs to be the circular drum shaped vessel in order to secure the strength thereof, and the various devices must each be arranged independently. In addition, upon adopting the circular drum shape, when the height dimension is secured, the width dimension becomes large at the same time. As a result, as described above, in actuality, it is difficult to make the height dimension H of the economizer 5 greater than the width dimension W.

However, according to the present embodiment, the economizer 5 has the rectangular shape and the condenser 3 and the subcooler 11 can be integrated with the economizer 5 by having a portion of the vessel walls of the circular drum shaped condenser 3/subcooler 11 form a shared wall with the economizer 5 whose height dimension H is greater than its width dimension W. Thus, an effect can be obtained of being able to make the centrifugal chiller 1 more compact. In addition, the liquid refrigerant condensed in the condenser 3 can be subcooled by the refrigerant that is separated and evaporated on the economizer 5 side, via the shared wall. Furthermore, heat exchange between the condenser 3 and the evaporator 7, which have a large difference in temperature between them, can be avoided.

Therefore, along with being able to reduce heat loss and improve efficiency, a subcooling degree is secured in a low load area and stable expansion valve control is realized, thus allowing stable and efficient operation to be performed. In addition, a difference of elevation is secured between the condenser 3/subcooler 11 and the economizer 5 and also between the economizer 5 and the evaporator 7. Thus, the flow of the refrigerant can also be secured due to gravity, without relying on the pressure difference. As a result, even when the high-low pressure difference has become small, the refrigerant flow can be reliably secured and stable operation can be performed.

Further, in the present embodiment, each of the respective decompression means provided to the front and rear of the economizer 5 is formed as the expansion valve, and a configuration is adopted in which the refrigerant piping 8B (or branching piping), which is provided with the first expansion valve 4 (or the expansion valve for the intercooler when the intercooler method is adopted) and is provided between the condenser 3/subcooler 11 and the economizer 5, and the refrigerant piping 8C, which is provided with the second expansion valve 6 and is provided between the economizer 5 and the evaporator 7, are disposed on the outside of each of the various devices.

In other words, the configuration is adopted in which the higher-stage decompression means, the lower-stage decompression means, and the economizer decompression means, which are the decompression means when a multi-stage compression refrigeration cycle is configured to be provided with the economizer 5 (which is the gas-liquid separator or the intercooler), are respectively the first expansion valve 4, the expansion valve for intermediate cooling, and the second expansion valve 6, and these various expansion valves are provided in the refrigerant piping 8B and 8C, and the branching piping provided on the outside of each of the devices. In this way, the flow amount of the refrigerant can be appropriately controlled as necessary in accordance with operating conditions, using the expansion valves 4 and 6, and the economizer expansion valve. Thus, controllability in the low load area is stabilized in particular, and stable and efficient operation can be realized.

Further, the economizer 5 is the rectangular shaped vessel, and the height dimension H thereof is greater than the width dimension W. As a result, a degree of freedom is imparted to a gas-side shape that forms the upper portion of the economizer 5, and a capacity thereof can be sufficiently secured, thus obtaining a configuration that makes carry-over of the economizer 5 unlikely. Thus, the centrifugal chiller 1 that forms the multi-stage compression refrigeration cycle can operate in a stable manner, and the reliability thereof can be improved.

Second Embodiment

Figure 3:
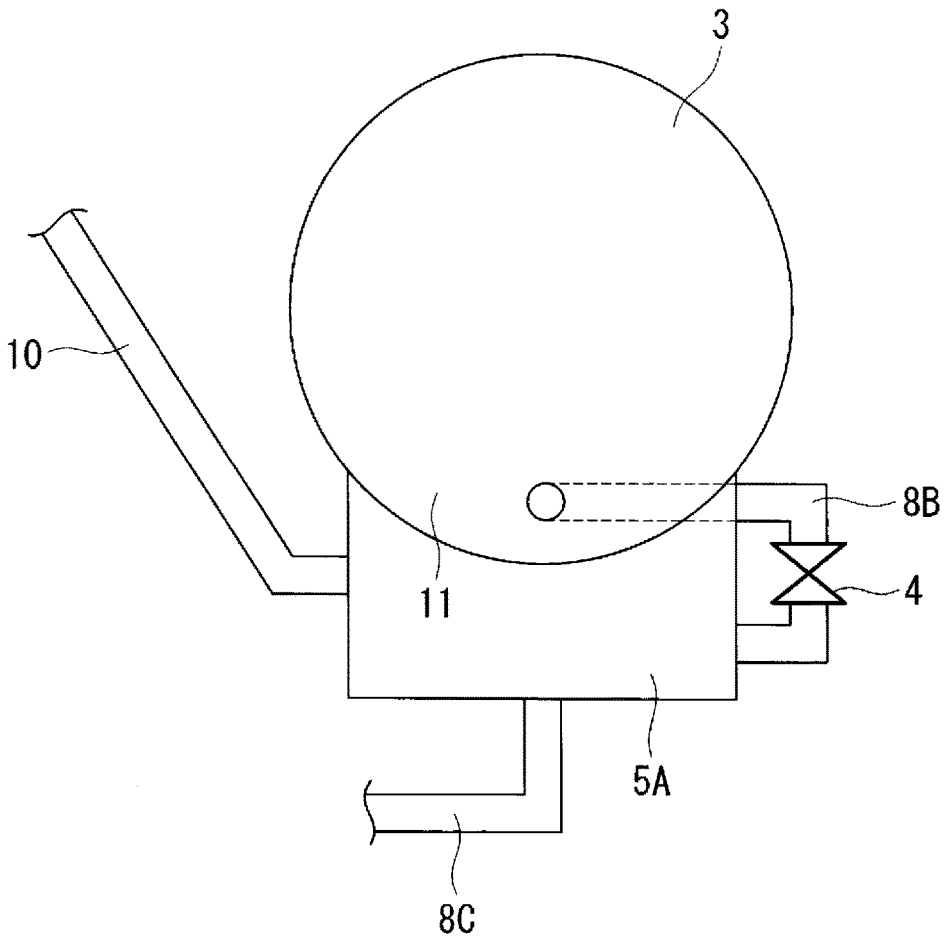
FIG. 3 is a configuration diagram illustrating a layout of various devices configuring a centrifugal chiller according to a second embodiment of the present invention.

Next, a second embodiment of the present invention will be described below, with reference to FIG. 3.

In the present embodiment, in contrast to the above-described first embodiment, an economizer 5A that is integrated with the condenser 3 and the subcooler 11 has a different configuration. Other points are similar to the first embodiment, so a description thereof is omitted here.

In the present embodiment, a configuration is adopted in which the economizer 5A is integrated with the condenser 3 and the subcooler 11 by having a portion of the vessel walls as a shared wall, such that the economizer 5A covers substantially all of the bottom portion of the circular drum shaped vessel configuring the condenser 3 and the subcooler 11.

In this way, a configuration is adopted in which the economizer 5A is integrated by having a portion of the vessel walls as a shared wall, such that the economizer 5 covers substantially all of the bottom portion of the condenser 3 and the subcooler 11. As a result, the bottom portion of the condenser and the subcooler 11, in which the condensed and liquefied refrigerant collects, is efficiently cooled via the shared wall with the economizer 5A, and the liquid refrigerant can be subcooled. Thus, even in the low load area in which the subcooler 11 cannot easily function, the liquid refrigerant can be appropriately subcooled, and the expansion valve control can be stabilized while avoiding a gas bypass.

Note that the present invention is not limited to the invention according to the above-described embodiments and can be modified as required without departing from the spirit of the present invention. For example, in the above-described embodiments, the configuration is adopted in which the economizer 5 or 5A is integrated by having a portion of the vessel walls of the condenser 3 and the subcooler 11 form a shared wall, and it is preferable for an area of the shared wall to be as large as possible, from the point of view of heat exchange efficiency.

Further, it is preferable that the base surface of the economizer 5 or 5A be positioned such that a surface of the liquid collected in the economizer 5 or 5A be lower than a surface of the liquid collected in the bottom portion of the condenser 3 and the subcooler 11, and the width dimension W may be set on the basis of the liquid surface heights. Further, from the point of view of inhibiting carry-over, it is preferable for the height dimension H of the economizer 5 or 5A to be as high as possible, and in the second embodiment also, similar to the first embodiment, a configuration may be adopted in which a portion of the economizer 5 or 5A is caused to extend upward as a modified shape.

REFERENCE SIGNS LIST

1 Centrifugal chiller
2 Multi-stage turbo compressor (compressor)
3 Condenser
4 First expansion valve (higher-stage decompression means)
5, 5A Economizer
6 Second expansion valve (lower-stage decompression means)
7 Evaporator
8, 8A, 8B, 8C, 8D Refrigerant piping
9 Refrigeration cycle
10 Economizer circuit
11 Subcooler

The invention claimed is:

1. A centrifugal chiller in which a closed-cycle refrigeration cycle is formed by connecting a compressor, a condenser, an economizer forming a multi-stage compression cycle, and decompression means, and an evaporator, the refrigeration cycle being charged with a low-pressure refrigerant during the cycle, the evaporator and the condenser being separately arranged so as not to share a wall, the condenser and the economizer being integrated with each other by having a portion of their vessel walls form a shared wall, a base surface of the economizer being positioned below a base surface of the condenser, and above a base surface of the evaporator, the decompression means comprising a first expansion valve provided to a first refrigerant piping connecting the condenser and the economizer, a connection part between the first refrigerant piping and the economizer being positioned below the base surface of the condenser, and the economizer being integrated with the condenser by having a portion of their vessel walls form a shared wall so as to cover a bottom portion of the condenser.

2. The chiller according to claim 1, wherein the decompression means further comprises a second expansion valve provided to a second refrigerant piping connecting the economizer and the evaporator, and wherein at least one of the first refrigerant piping and second refrigerant piping is provided on the outside of various devices.

3. The chiller according to claim 2, wherein a height dimension H of a vessel of the economizer is greater than a width dimension W thereof.

4. The chiller according to claim 1, wherein a height dimension H of a vessel of the economizer is greater than a width dimension W thereof.

* * * * *